US007015410B2

(12) United States Patent
Einschenk et al.

(10) Patent No.: US 7,015,410 B2
(45) Date of Patent: Mar. 21, 2006

(54) DRIVE DEVICE FOR A SWITCHING TUBE WITH A FIXED AND MOVABLE CONTACT PART

(75) Inventors: Jürgen Einschenk, Zepernick (DE); Norbert Steinemer, Falkensee (DE); Stephan Welzel, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/488,696

(22) PCT Filed: Sep. 3, 2002

(86) PCT No.: PCT/DE02/03326

§ 371 (c)(1),
(2), (4) Date: Mar. 5, 2004

(87) PCT Pub. No.: WO03/023804

PCT Pub. Date: Mar. 20, 2003

(65) Prior Publication Data

US 2004/0238494 A1 Dec. 2, 2004

(30) Foreign Application Priority Data

Sep. 5, 2001 (DE) ..... 101 44 438

(51) Int. Cl.
*H01H 33/66* (2006.01)

(52) U.S. Cl. ..... 218/140; 218/154

(58) Field of Classification Search ..... 218/140, 218/153, 120, 154, 2, 7, 14, 78, 84; 200/400, 200/401; 361/71, 72, 115
See application file for complete search history.

(56) References Cited

U.S. PATENT DOCUMENTS 3,511,944 A * 5/1970 Parks et al. ..... 200/17 R (Continued)

FOREIGN PATENT DOCUMENTS

| | | |
|---|---|---|
| DE | 72 07 390 | 2/1972 |
| DE | 41 33 091 | 9/1991 |
| GB | 2 274 545 | 9/1993 |

OTHER PUBLICATIONS

"Vakuum-Leistungsschalter-ein neuer Weg im Bereich der Mittelspannung," Sachsenwerk, Mar. 1982, pp. 11.

*Primary Examiner*—Elvin Enad
*Assistant Examiner*—Marina Fishman
(74) *Attorney, Agent, or Firm*—Morrison & Foerster LLP

(57) ABSTRACT

The invention relates to a drive device for a switching tube with a fixed and movable contact part, said movable contact part being controlled by a plastic switch rod (SS) which remains substantially unstressed when the contact parts are connected or disconnected and the force of the contact spring (KF) when the contact parts are connected is approximately fully exerted on the movable contact part of the switching tube. The actuating lever and the pendulum lever are replaced by drive levers (AH, AH') having a triangular contour and which are fitted with a pivoting rotational bearing (SL . . . ) in each corner area, said drive levers (AH . . . ) being provided with a centrical pivoting bearing (SLm) for receiving the rotationally mounted contact spring (KF) and the centrical pivoting rotational bearing (SLm) between an upper pivoting rotational bearing (Slo) connected to the switch rod (SS) and a lower pivoting rotational bearing (SLu) connected to the drive (AT) of the movable contact part and the contact spring (KF) is mounted on one side in a fixed spherical cap guide (KG). The contact pressure force for the drive (AT) of the movable contact part can be regulated by altering the active path length of the contact spring (KF). The active path length of the contact spring can be continuously adjusted by a regulating screw (RS) which is accessible from the outside.

2 Claims, 2 Drawing Sheets

U.S. PATENT DOCUMENTS 4,064,383 A * 12/1977 Barkan ..... 218/120
4,099,039 A * 7/1978 Barkan ..... 218/140
4,323,871 A * 4/1982 Kamp et al. ..... 337/7
5,422,450 A * 6/1995 Miyazawa et al. ..... 218/140
5,512,724 A 4/1996 Binder et al.
6,002,560 A * 12/1999 Nguyen et al. ..... 361/23

* cited by examiner

DRIVE DEVICE FOR A SWITCHING TUBE WITH A FIXED AND MOVABLE CONTACT PART

CLAIM FOR PRIORITY

This application claims priority to International Application No. PCT /DE02/03326, which was published in the German language on Mar. 20, 2003, and which claims the benefit of priority to German Application No. DE 10144438.9, filed on Sep. 5, 2001.

BACKGROUND OF THE INVENTION

A drive device of the type described above is known from the publication "Vakuum-Leistungsschalter—ein neuer Weg im Bereich der Mittelspannung" [Vacuum power breakers—a new option in the medium-voltage range], Sachsenwerk, March 1982, pp. 11 et seq.

In the disconnected state of the contact parts, the movable contact part is connected in a force-free manner to the pendulum-type lever by being mounted centrally such that it can pivot, whereas the pendulum-type lever is itself, on the one hand, connected to the housing of the interrupter by means of an external pivot bearing and, on the other hand, is connected, by means of an internal pivot bearing lying opposite the external pivot bearing, to the contact spring which is mounted at both ends such that it can pivot. The other free end of the contact spring is connected to the central pivot bearing of a three-point lever, which is likewise mounted such that it can pivot on the housing of the interrupter and whose other external pivot bearing is under the controlling influence of the plastic switching rod.

The connected state of the contact parts is achieved by the three-point lever being pivoted by means of the switching rod in the clockwise direction in the region of its external bearing such that the contact spring is positioned approximately parallel to the direction of action of the contact pressure force, and thus the switching rod is in practice no longer subjected to the contact pressure force. The contact pressure force therefore now only acts on the movable contact part of the interrupter.

Readjustments or alterations to the contact pressure forces are not provided for here and cannot be carried out without a considerable degree of installation complexity.

SUMMARY OF THE INVENTION

The invention relates to a drive device for an interrupter having a fixed and a movable contact part, the movable contact part being controlled by a plastic switching rod such that, by a contact spring, which is mounted at both ends such that it can pivot and is arranged between a first point at which an actuating lever of the switching rod is mounted such that it can pivot and by a second point at which a pendulum-type lever of the drive of the movable contact part is mounted such that it can pivot, the switching rod is largely load-free in the connected and disconnected state of the contact parts, and the force of the contact spring in the connected state of the contact parts acts almost entirely on the movable contact part of the interrupter.

The invention, while maintaining the unloaded switching rod in the connected and disconnected state, specifies a drive device with which it is possible to alter the contact travel and thus also the contact pressure forces within wide ranges, and which can be adjusted largely without additional installation complexity.

In one embodiment of the invention, 1.1 the actuating lever and the pendulum-type lever are replaced by drive levers having a triangular contour which are fitted in each corner region with a respective pivot bearing, 1.2 the drive levers each have a central pivot bearing for accommodating the contact spring which is mounted such that it can pivot, 1.3 the central pivot bearing is arranged between an upper pivot bearing which is connected to the switching rod and a lower pivot bearing which is connected to the drive of the movable contact part, 1.4 the contact spring is mounted at one end in a stationary collar guide, 1.5 it is possible to regulate the contact pressure force for the drive of the movable contact part by altering the active path length of the contact spring, and 1.6 it is possible to adjust the active path length of the contact spring in a stepless manner by means of a regulating screw which is accessible from the outside.

With the contact spring which is mounted in the collar guide and can be pivoted within narrow limits, in relation to the drive lever having a triangular contour and with its pivot bearings in the corner regions, it is still possible to mechanically relieve the switching rod in the two switching states of the contact springs, that is in the connected state and in the disconnected state. The fact that the contact spring which is mounted such that it can pivot is connected in the central pivot bearing, the switching rod engages in the upper pivot bearing of the drive lever, and the drive of the movable contact part engages in the lower pivot bearing of the drive lever means that, in practice, a coupler mechanism is formed in which the switching rod is not subjected to any load by the contact spring in these two switching states. If there is a need to subsequently adjust the contact pressure force in a simple manner without bringing about additional mechanical complexity, this is possible, in practice, from the outside without additional installation complexity. An alteration to the path length of the contact spring may also be adjusted in a stepless manner using the regulating screw and is possible within wide limits when the collar mounting and the adjusting elements are designed accordingly.

One advantageous embodiment of the invention provides 2.1 the drive levers to be arranged centrally symmetrically with respect to the switching rod, and 2.2 the drive of the movable contact part to surround the drive levers centrally symmetrically with its u-profile which is open at the bottom.

These measures make it possible for the contact pressure forces exerted when the movable contact parts are switched to be transferred such that they are uniformly distributed over the drive levers taking part in the kinematic operation and their pivot bearings and also over the drive of the movable contact part which is common to these pivot bearings.

BRIEF DESCRIPTION OF THE DRAWINGS

The invention will be explained in more detail by the exemplary embodiments represented in the figures, in which.

DETAILED DESCRIPTION OF THE INVENTION

Figure 1:
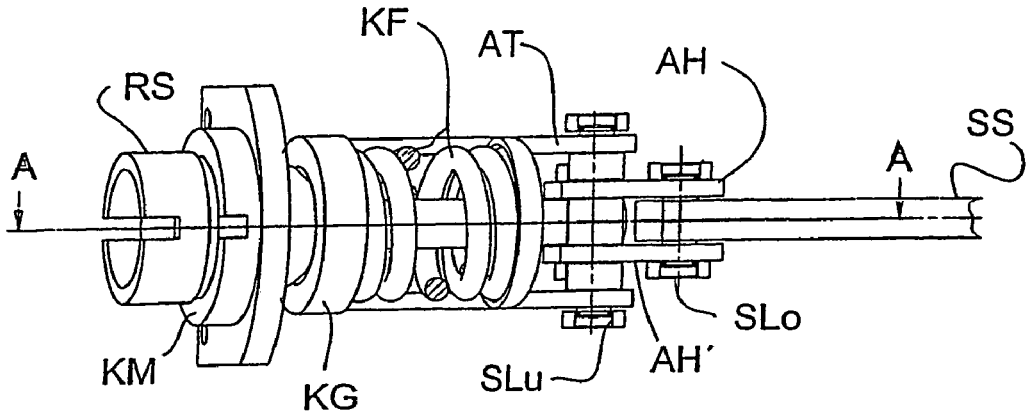
FIG. 1 shows a view from below the drive device.

FIG. 1 shows a view from below of the drive device which shows in particular the mounting of the switching rod SS in the upper pivot bearing SLo in the respective drive lever AH, AH' and the mounting of the drive AT of the movable contact part in the lower pivot bearing SLu. Also shown is the fact that the contact spring KF is mounted fixedly in the region of the housing wall (not shown) of the pole base in the collar guide KG.

Figure 2:
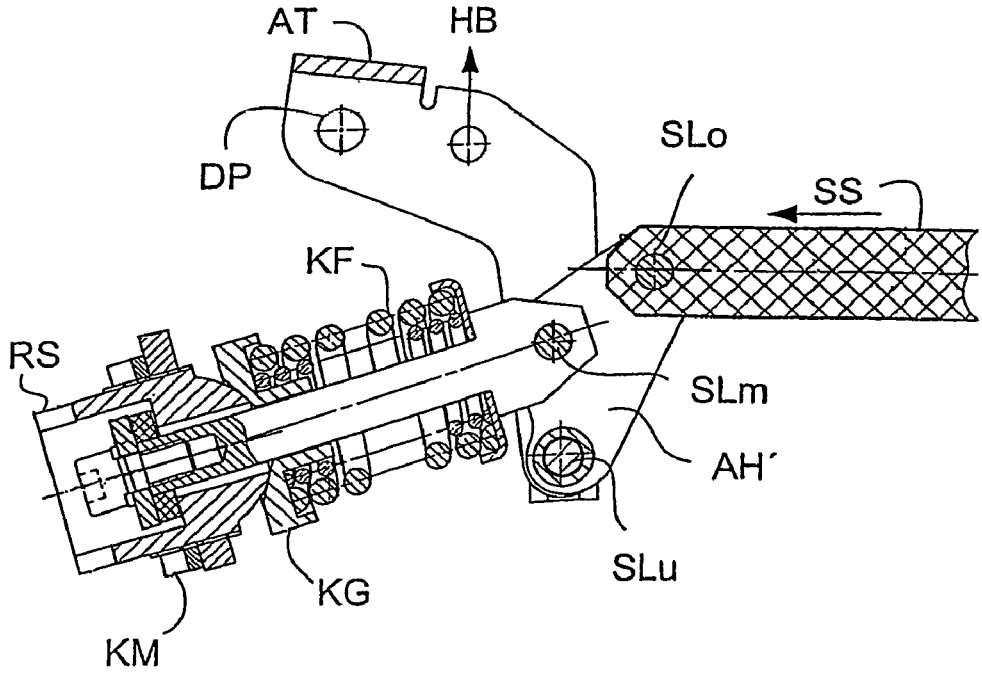
FIG. 2 shows a sectional diagram in the arrow directions A—A in FIG. 1.

FIG. 2 shows a sectional diagram of the drive device with the viewing direction A shown in FIG. 1. This representation shows in particular the triangular contour of the drive levers AH, AH', it being possible to see the drive lever AH' owing to the sectional representation. It may also be seen here that the switching rod SS is mounted in the upper pivot bearing SLo of the drive lever AH', and the drive AT of the movable contact part is arranged in the lower pivot bearing SLu. Located between the upper pivot bearing SLo and the lower pivot bearing SLu is the central pivot bearing SLm, which accommodates the contact spring KF which is mounted such that it can pivot. It can also be seen from FIG. 2 that the contact spring KF is guided from the side remote from the central pivot bearing SLm in the collar guide KG, and is supported on the opposing piece (not shown) of the collar guide KG, this opposing piece being fixedly connected to the pole base (likewise not shown). It is possible to use the regulating screw RS to alter the active path length of the contact spring KF such that the contact pressure, illustrated by the travel movement HB, can thus be altered in a stepless manner. The regulating screw RS is secured against being displaced by the locking nut KM. The drive AT of the movable contact part is in this case mounted such that it can pivot on the stationary pivot DP. As soon as the push rod SS is actuated in the direction of the arrow, switching takes place from the disconnected state to the connected state by the drive lever (only the drive lever AH' can be seen) being pivoted in the direction of the contact spring KF. This movement causes the central pivot bearing SLm to pivot in the same way in the direction of the lower pivot bearing SLu, while the lower pivot bearing SLu is pivoted away from the contact spring KF. Since the drive AT of the movable contact part is fixedly anchored in the pivot DP, this pivoting brings about the travel movement HB, with which, finally, the movable contact part is pressed against the fixed contact part of the interrupter. The contact parts of the interrupter are now in the connected state, without in turn the contact spring KF exerting any force on the switching rod SS. The drive levers AH, AH' and the pivot bearings fitted to the drive levers in practice form a coupler mechanism, in which the switching rod SS, both in the connected and in the disconnected state of the contact parts, is not subjected to any load by the contact spring KF.

Figure 3:
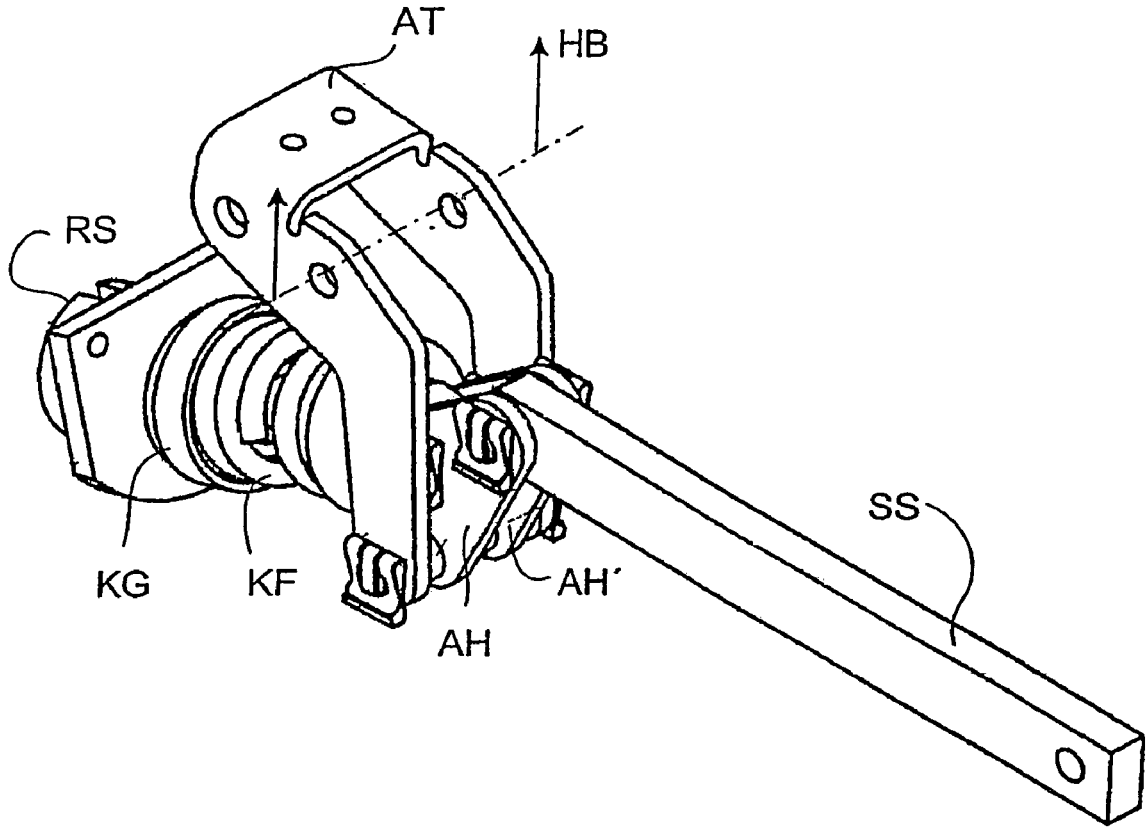
FIG. 3 shows a perspective representation of the drive device.

FIG. 3 shows a perspective representation of the drive device which shows, in particular, the manner in which the individual functional elements cooperate mechanically with one another and the way in which the travel movement HB are transferred via the drive AT to the movable contact parts (not shown) of the interrupter (likewise not shown).

The invention claimed is:

1. A drive device for an interrupter having a fixed and a movable contact part, wherein the movable contact part is controlled by a switching rod, the drive device comprising:

a drive to drive the movable contact part, wherein the drive is mounted such that it rotates around a stationary pivot, drive levers, each having a triangular contour, which are fitted in each corner region with a respective pivot bearing and each have a central pivot bearing for accommodating a contact spring which is mounted such that it can pivot, the central pivot bearing being arranged between an upper pivot bearing which is connected to the switching rod and a lower pivot bearing which is connected to the drive, wherein the contact spring comprises a first end and a second end, and is mounted at the first end in a stationary collar guide, and configured such that a contact pressure force for the drive may be regulated by altering an active path length of the contact spring, and configured to adjust the active path length of the contact spring in a stepless manner by a regulating screw which is accessible from the outside of the drive device, the drive is controlled by the switching rod such that the switching rod is not substantially subjected to a force of the contact spring when the drive is in either a connected state or a disconnected state, and the force of the contact spring acts substantially on the drive when the drive is in the connected state.

2. The drive device of claim 1, wherein the drive levers are arranged centrally symmetrically with respect to a switching rod, and the drive surrounds the drive levers centrally symmetrically with a u-profile which is open at a bottom.

* * * * *